United States Patent [19]

Masek

[11] Patent Number: 4,610,493

[45] Date of Patent: Sep. 9, 1986

[54] ELECTRICAL CONNECTOR BLOCK

[75] Inventor: Richard C. Masek, Wickliffe, Ohio

[73] Assignee: The Babcock & Wilcox Company, New Orleans, La.

[21] Appl. No.: 822,916

[22] Filed: Jan. 24, 1986

Related U.S. Application Data

[63] Continuation of Ser. No. 590,931, Mar. 19, 1984, abandoned.

[51] Int. Cl.[4] ..... H01R 4/24

[52] U.S. Cl. ..... 339/14 R; 339/99 R

[58] Field of Search ..... 339/14, 97 R, 97 P, 339/98, 99 R, 143, 193 P

[56] References Cited

U.S. PATENT DOCUMENTS

| | | | |
|---|---|---|---|
| 2,802,083 | 8/1957 | Lapeyre | 339/99 R |
| 3,189,863 | 6/1965 | Leach | 339/99 R |
| 3,255,429 | 6/1966 | Forney, Jr. | 339/99 R |
| 3,702,982 | 11/1972 | Kelly et al. | 339/99 R |
| 3,877,771 | 4/1975 | Jensen et al. | 339/99 R |
| 4,009,921 | 2/1977 | Narozny | 339/99 R |
| 4,027,941 | 6/1977 | Narozny | 339/98 |
| 4,068,912 | 1/1978 | Hudson, Jr. et al. | 339/99 R |
| 4,073,560 | 2/1978 | Anhalt et al. | 339/99 R |
| 4,272,146 | 6/1981 | Simon et al. | 339/99 R |
| 4,410,229 | 10/1983 | Stephenson | 339/98 |

*Primary Examiner*—Joseph H. McGlynn

*Attorney, Agent, or Firm*—Vytas R. Matas; Robert J. Edwards

[57] ABSTRACT

An electrical connector block for a flat ribbon cable having a plurality of conductors lying side-by-side in an insulating ribbon comprises a base having a plurality of terminals extending therethrough lying in a plurality of rows. Each terminal has an upper connection end a lower insulation-piercing end. At least one terminal is aligned with each conductor in the ribbon so that, when the base is pressed against the ribbon, the terminals contact the conductors of the ribbon. Components can be connected between terminals of each row and held on the base for interconnecting conductors in the ribbon or connecting the conductors to a ground. A top cover includes a recess for covering the components and is engaged over the base while a bottom cover is engaged under the base and includes a plurality of slots for accommodating any displacement of the ribbon after it has been pierced by the insulation-piercing ends of the terminals.

9 Claims, 7 Drawing Figures

ELECTRICAL CONNECTOR BLOCK

This application is a continuation of application Ser. No. 06/590,931 filed Mar. 19, 1984, now abandoned.

FIELD AND BACKGROUND OF THE INVENTION

The present invention relates, in general, to electrical connectors and, in particular, to a new and useful electrical connector block for making connections to a flat ribbon cable having a plurality of conductors lying side by side in an insulating ribbon.

The proper grounding of electrical equipment is important since transients may be generated internally or externally of the equipment which must find a pathway to ground or else damage may occur to the equipment or injury may occur to persons handling the equipment.

Transient protectors absorb this energy and minimize damage or prevent excessive voltage from leaving the equipment. Typically the transient protectors are soldered onto a circuit board or to a connector. High density boards have little room for such transient protectors, however. Standard insulation displacement connectors do not have exposed metal where the transient protectors can be added.

A particular danger may exist in CRT's (cathode ray tubes) where high voltage in the CRT's could propagate outside the enclosure of the devices via signal lines connected to the devices. Such propagation can cause fire, shock and/or equipment damage. Another concern is that the high voltage in the signal wires can arc over to other circuits or bare metal. If these wires are connected to equipment in a hazardous location, such as in the proximity of flammable or explosive material, this arc can cause ignition of this material.

It is desirable that any voltage on any signal leading out of a CRT be less than 250 volts a.c. with respect to ground (earth). The anode voltage in a CRT could be 14,000 to 35,000 volts. The capacitance of the anode could be 500 to 2,500 pFd.

Transient protectors for lines leaving a CRT would thus be desirable, particularly in view of the small amount of space which is generally available on circuit boards of such devices.

Electrical connector blocks having insulation-piercing bifurcated contacts or tines for the formation of electrical connections have been described in U.S. Pat. Nos. 3,012,219 and 3,820,058. These connector blocks include one or more rows of insulation-piercing contacts for piercing the insulation of a multi-conductor ribbon cable or other insulated conductors. Also, a number of connector blocks are known in the prior art for common or ground termination of alternate drain conductors or a ground plane in a multi-conductor flat ribbon cable. Such connector blocks are disclosed in U.S. Pat. Nos. 3,634,806, 3,731,251, 3,864,011 and 3,912,354.

The prior art does not teach the placement of signal conducting resistors or surge suppression devices in shunt or parallel with two or more conductors in a ribbon cable.

SUMMARY OF THE INVENTION

The present invention provides a connector block which is particularly suited for a ribbon cable and provides contact to conductors in the cable as well as locations for mounting components on the block which are connected between conductors in the cable or between a conductor and a ground connection.

The connector block of the invention is provided on the ribbon itself so that no access or space is required of the circuit board to which the ribbon is connected. This also facilitates retrofitting of pre-existing assemblies.

Accordingly, an object of the present invention is to provide an electrical connector block for flat, ribbon cables which includes a base for carrying a plurality of terminals having at least one insulation piercing end, a top cover portion and a bottom cover portion. The ribbon is fixed between the base and bottom cover portion with the top cover portion having a recess for containing components connected between terminals on the base. The bottom cover includes a plurality of cavities which provide room for the insulation piercing end of the terminals which can project through the insulation of a ribbon and into contact with a conductor of the ribbon.

A further object of the invention is to provide an electrical connector block which is simple in design, rugged in construction and economical to manufacture.

For an understanding of the principles of the invention, reference is made to the following description of typical embodiments thereof as illustrated in the accompanying drawings.

DESCRIPTION OF THE PREFERRED EMBODIMENTS

Figure 1:
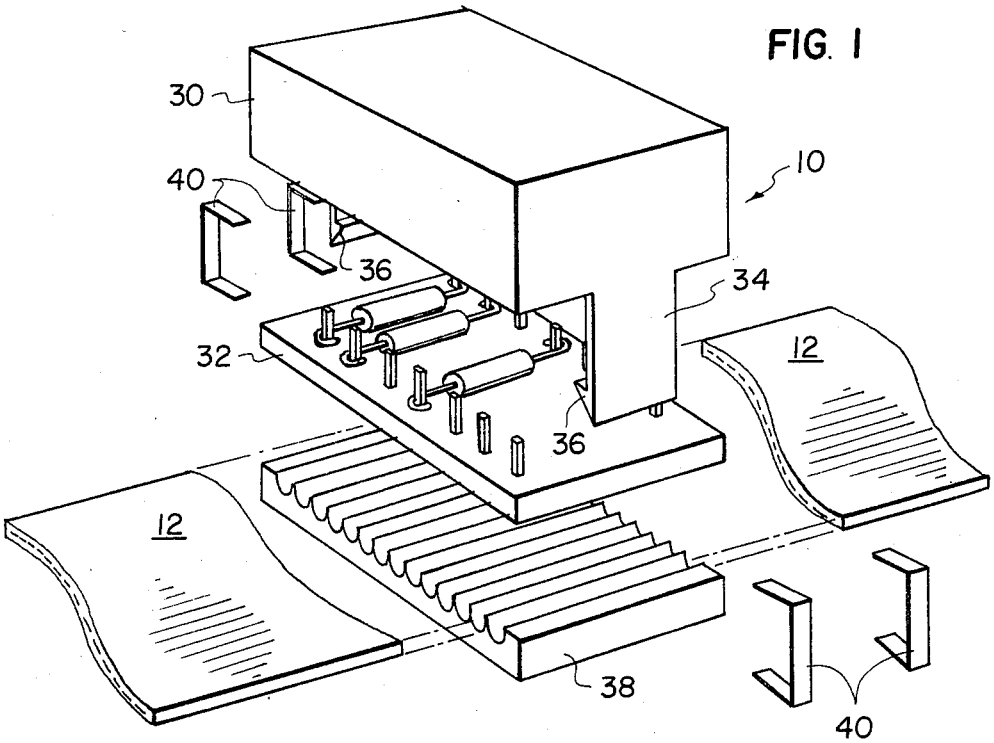
FIG. 1 is a perspective, exploded view of an electrical connector block according to the invention.
Figure 2:
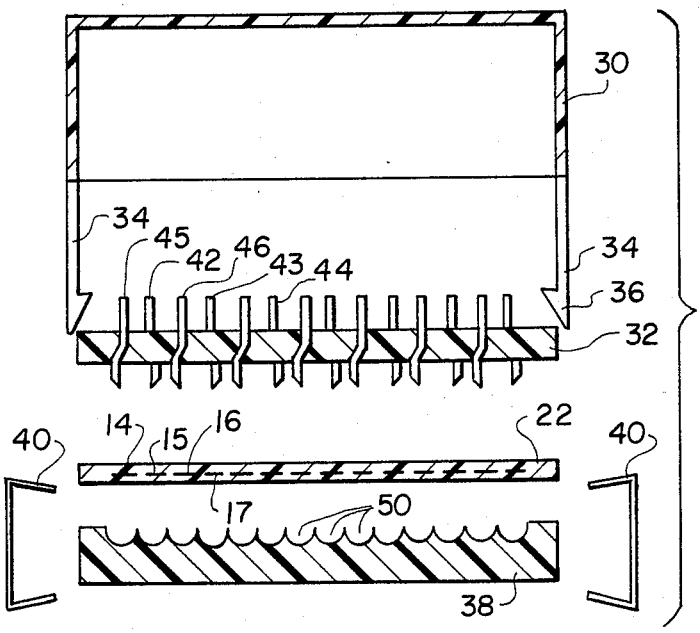
FIG. 2 is an exploded sectional view of the connector block of FIG. 1.
Figure 3:
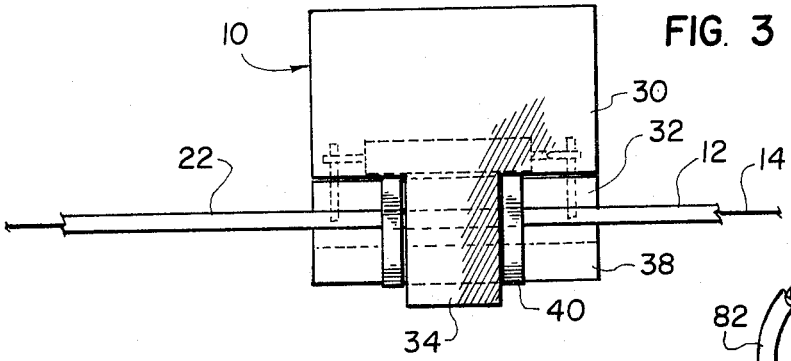
FIG. 3 is a side elevational view of the block in association with a ribbon in an engaged position on the ribbon.

Referring to the drawings, in particular, the invention embodied in FIGS. 1, 2 and 3 comprise an electrical connector block generally designated 10 for a flat ribbon cable 12 having a plurality of side-by-side conductors 14 through 17 which are enclosed within an insulating ribbon 22.

Block 10 comprises a top cover 30 which covers components connected to a base member 32. Top cover 30 includes arms 34 with hooks or shoulders 36 which engage under a bottom cover 38. Arms 34 have the dual purpose of holding cover 30 on base 32 as well as holding bottom cover 38 up into engagement with the ribbon 12. Spring metal clips 40 are also provided on both ends of the block and on either side of the arms 34 for holding base 32 to bottom cover 38.

Base 32 as shown best in FIG. 2, includes a plurality of terminals or contacts 42 through 46. Each contact extends through base 32 and includes a lower insulation piercing end. The lower end can be bifurcated, not shown, or tine-shaped. It is important the insulation-piercing end of the terminals or contacts be sufficiently long to pierce the insulation of ribbon 22 and come into contact with one of the conductors in the ribbon.

To further facilitate this contact, bottom cover 38 is provided with a plurality of cavities or recess slots 50 which are disposed under each conductor.

Terminals or contacts 42 through 44 automatically pierce the insulation and come into contact with the conductors when the block is assembled.

Figure 4:
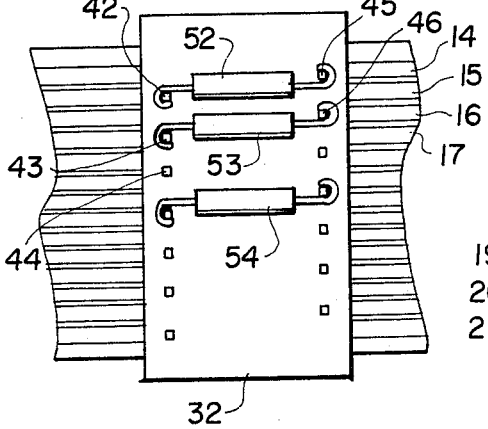
FIG. 4 is a top plan view of the base of the connector block of FIG. 1.

As shown in FIG. 4, a plurality of components 52, 53 and 54 can be connected, for example by soldering, between terminals in the first row of terminals containing contacts 42, 43 and 44, and the second row of terminals containing contacts 45 and 46. These components may, for example, be resistors or diodes. In FIG. 4, component 52 is shown connected between adjacent conductors 14 and 15 by its connection with terminals 42 and 45. In a similar fashion, component 53 is shown connected between terminals 43 and 46 and thus interconnect adjacent conductors 16 and 17. Components can be arranged in other manners, however, to connect anyone conductor with any other conductor and also to provide this connection with a selected component, such as a resistor or diode.

Figure 5:
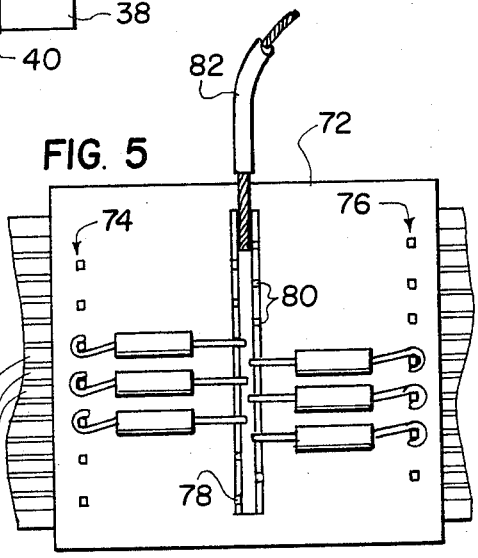
FIG. 5 is a top plan view of a base of another embodiment of the invention.
Figure 6:
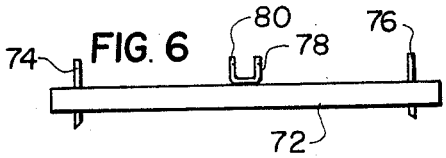
FIG. 6 is a side elevational view of the base shown without components.

FIGS. 5 and 6 show the use of the invention as a transient protector. In this case, block 72 includes a first row of terminals or contacts at 74 and a second row at 76. A bus line 78 having slots 80 is fixed near the center of the base 72. Transient protection for each conductor including conductors 19, 20 and 21 is provided by a ground wire 82 which has one end fixed, for example, by clamping or soldering to bus line 78.

Figure 7:
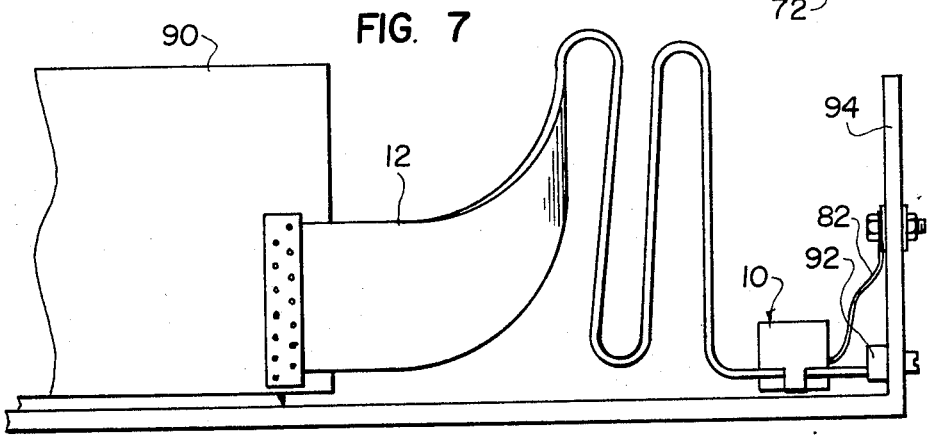
FIG. 7 is a side elevational view of a circuit board with ribbon connector outfitted with the inventive electrical connector block.

FIG. 7 shows a ribbon 12 connected between a circuit board 90 and a standard displacement connector 92. At some point along the ribbon, connector box 10 is engaged and is shown with ground wire 82 connected by a nut and bolt combination to a chassis 94 which supports the circuit board 90.

While specific embodiments of the invention have been shown and described in detail to illustrate the application of the principles of the invention, it will be understood that the invention may be embodied otherwise without departing from such principles.

What is claimed is:

1. An electrical connector block for providing transient protection for a flat ribbon cable having a plurality of conductors lying side-by-side in an insulating ribbon connectable to a circuit board mounted in a chassis comprising:

a base member adapted to lie over a portion of the ribbon cable;

a plurality of terminal contacts extending through said base member and having an upper connection end and a lower insulation-piercing end, said plurality of terminals disposed in said base member in a pattern so that at least some of said terminals are engageable over said insulation-piercing ends thereof to at least some conductors of the ribbon cable;

a bottom cover engageable on an opposite side of a ribbon cable from said base member;

mounting means connected between said base member and said bottom cover for urging said base member and bottom cover together with a ribbon cable therebetween;

a bus line suitable for connection to a ground wire being located on the upper end of said base member;

said plurality of terminal contacts being connected to said bus line; and a ground wire connecting said bus line to said chassis for providing transient protection to the circuit board thereby.

2. An electrical connector block according to claim 1 including a top cover having a recess and engaged over said base member for covering said at least one component and said terminals.

3. An electrical connector block according to claim 2, wherein said top cover includes a pair of arms extending toward and engaged with said bottom cover on opposite sides of said bottom cover.

4. An electrical connector block according to claim 3, wherein said mounting means includes a plurality of clips engaged between said base member and said bottom cover for holding said base member and said bottom cover together.

5. An electrical connector block according to claim 2, wherein said plurality of terminal contacts lie in a pair of spaced-apart rows, said at least one component connected between a terminal contact of one row and a terminal contact of the other row, a spacing between each terminal contact in each row being at least equal to a spacing between side-by-side conductors in the ribbon cable.

6. An electrical connector block according to claim 5, wherein each terminal in one row is spaced by an amount to engage each other conductor in the ribbon cable and each conductor in the other row is spaced to engage a conductor not contacted by a terminal contact of the first-mentioned row.

7. An electrical connector block according to claim 6, wherein said mounting means include a plurality of clips engaged on opposite sides of said base member and bottom cover, and between said base member and bottom cover, said mounting means also including said top cover having a pair of arms extending toward and into engagement with said bottom cover for holding said top cover to said bottom cover and said base member and the ribbon cable between said top cover and bottom cover.

8. An electrical connector block according to claim 1, having at least one component connected between at least two of said plurality of terminal contacts for connection at at least one conductor of the ribbon cable.

9. An electrical connector block according to claim 1, wherein said bus line is slotted and is centrally located on said base member.

* * * * *